US007056149B1

(12) United States Patent
Lanni

(10) Patent No.: US 7,056,149 B1
(45) Date of Patent: Jun. 6, 2006

(54) KEY CODED POWER ADAPTER CONNECTORS

(75) Inventor: Thomas W. Lanni, Laguna Niguel, CA (US)

(73) Assignee: Comarco Wireless Technologies, Inc., Irvine, CA (US)

( * ) Notice: Subject to any disclaimer, the term of this patent is extended or adjusted under 35 U.S.C. 154(b) by 0 days.

(21) Appl. No.: 10/987,361

(22) Filed: Nov. 12, 2004

(51) Int. Cl.
*H01R 3/00* (2006.01)

(52) U.S. Cl. ..... 439/488; 439/491; 439/680

(58) Field of Classification Search ..... 439/680, 439/488, 491, 489
See application file for complete search history.

(56) References Cited

U.S. PATENT DOCUMENTS

| | | | | |
|---|---|---|---|---|
| 4,368,942 | A | 1/1983 | Mathe | |
| 4,764,129 | A * | 8/1988 | Jones et al. | 439/677 |
| 4,820,204 | A * | 4/1989 | Batty | 439/681 |
| 4,990,099 | A * | 2/1991 | Marin et al. | 439/284 |
| 5,147,226 | A | 9/1992 | Kile | |
| 5,417,585 | A | 5/1995 | Morin | |
| 5,449,302 | A * | 9/1995 | Yarbrough et al. | 439/680 |
| 5,790,896 | A * | 8/1998 | Nguyen | 710/72 |
| 6,080,022 | A * | 6/2000 | Shaberman et al. | 439/680 |
| 6,091,611 | A | 7/2000 | Lanni | |
| 6,172,884 | B1 | 1/2001 | Lanni | |
| 6,257,932 | B1 | 7/2001 | Neely | |
| 6,266,261 | B1 | 7/2001 | Lanni | |
| 6,302,744 | B1 | 10/2001 | Nomura | |
| 6,382,842 | B1 | 5/2002 | Arima et al. | |
| 6,929,516 | B1 * | 8/2005 | Brochu et al. | 439/677 |
| 2002/0070702 | A1 * | 6/2002 | Ragnarsson | 320/101 |
| 2005/0197018 | A1 * | 9/2005 | Lord | 439/680 |

* cited by examiner

*Primary Examiner*—Hae Moon Hyeon
(74) *Attorney, Agent, or Firm*—Pillsbury Winthrop Shaw Pittman LLP

(57) ABSTRACT

A key coded power connector and a system and method for making key coded power connections are disclosed. A power connector such as a power adapter connector is configured with a visual and physical keying system. The physical keying system prevents a user from connecting a host device to a connector of the power source which does not support that host device. The visual keying system provides the user with an early indication that the particular device is not supported by a power source. The user can visually compare a marking key on the host device with the making key on the power connector and determine whether or not the power source is capable of outputting sufficient power to operate the device. The combination of the visual and physical keying systems prevents a user from improperly connecting a host device to a power source which does not support that device.

19 Claims, 6 Drawing Sheets

KEY CODED POWER ADAPTER CONNECTORS

FIELD OF INVENTION

Embodiments of the present invention relate to interconnectable power connectors including power adapter connectors and power cable assemblies providing key coded power connectors.

BACKGROUND OF THE INVENTION

With the continued growth and availability of consumer electronic devices on the market, consumers have accumulated a variety of such devices many of which require power adapters or connectors to a power source. These devices include laptop computers, handheld devices such as personal digital assistants (PDA), cellular telephones, digital cameras, audio recorders, Compact Disc (CD) players, MP3 players and portable digital video disc (DVD) players. Each device may be of varying form factor and power consumption requirements. As such, there are designated power adapters which may be used to properly supply power to each device. However, often the respective power adapters are very similar in appearance. Because many electronic devices are used by consumers who are unaware of the power consumption requirements for the particular device they seek to operate, the ability to physically connect a device to an incompatible power source may be problematic and have undesirable consequences. For example, if a consumer connects a device to a source that is incapable of delivering sufficient power to the device, the device will not work leaving the user to question the integrity of the device and/or the power source.

SUMMARY OF THE INVENTION

This present invention is directed to key coded power adapter connectors for providing consumer friendly connection between power adapters and host devices. It is an object of the invention to prevent consumers from connecting electronic devices to inappropriate power sources. A keying system is used to provide not only a physical indication of an inappropriate connection but a visual indication as well.

DETAILED DESCRIPTION OF THE INVENTION

Figure 1:
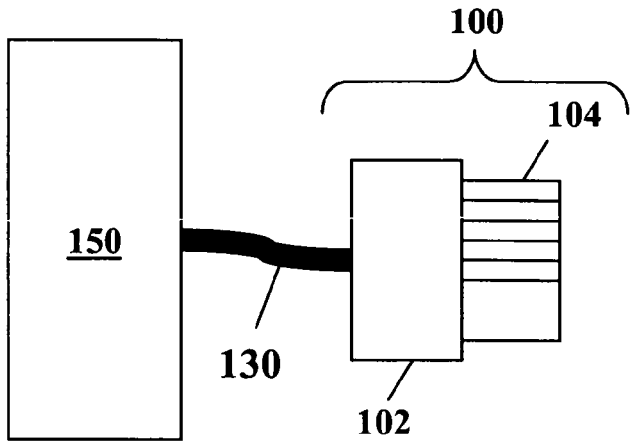
FIG. 1 illustrates a block diagram of a power connector system according to an embodiment of the present invention.

FIG. 1 illustrates a block diagram of a power connector system according to an embodiment of the invention. Power connector 100 is provided and may be coupled to a power source 150 by cable connector 130. The power source 150, which may be an AC source or a DC source, is capable supplying a designated measure of power to a connected electronic device. For example, the power source may be an electrical outlet, a power supply coupled to an electrical outlet, a power generator, a power adapter, a programmable power supply, or a battery.

Power connector 100 has an outer housing 102 and an inner housing 104 both of which may be substantially rectangular in shape. Both the inner housing 104 and the outer housing 102 may be formed in any shape including, but not limited to a circle, a square, a triangle and a star. Further, the inner housing 104 may be configured to have a different shape than that of the outer housing 102.

Outer housing 102 may be constructed of a durable insulating material, including but not limited to plastic, which may be used to shield power connector 100 from environmental conditions which may compromise the integrity of power connector 100 such as electromagnetic interference, physical force or other conditions.

Figure 2:
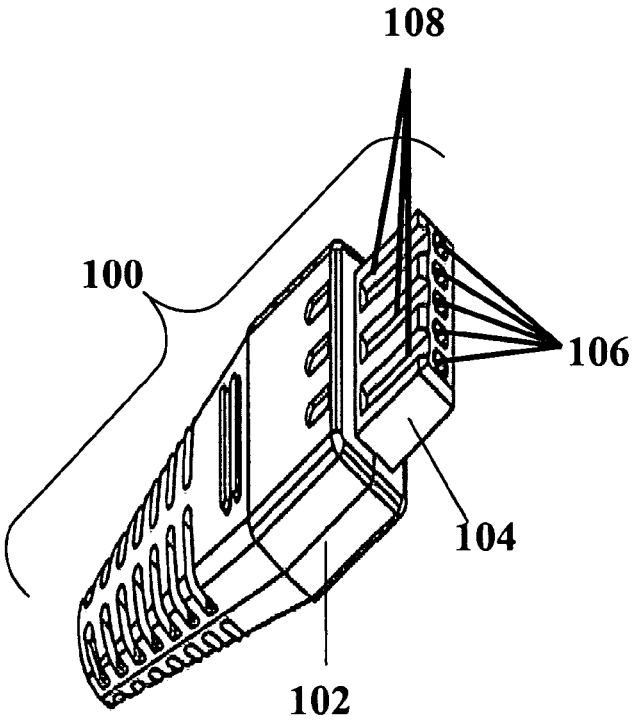
FIG. 2 illustrates a perspective view of a power connector according to an embodiment of the present invention.
Figure 3:
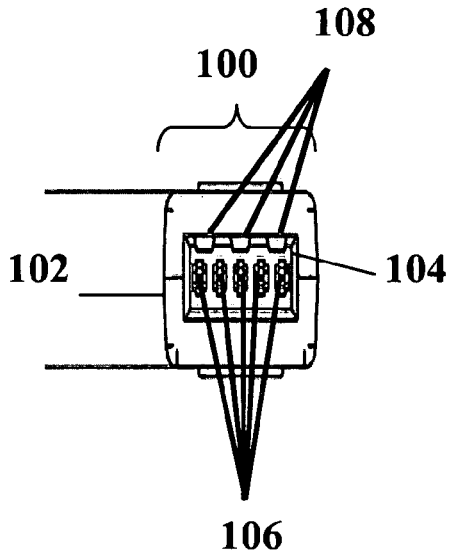
FIG. 3 illustrates a front view of a power connector according to an embodiment of the present invention.

As shown in FIGS. 2 and 3, inner housing 104 may be symmetrically disposed within and protrude from an interior of outer housing 102. Inner housing 104 includes a plurality of channels 108 along an external surface and a circuit interface having a plurality of electrical contacts 106 disposed at predetermined positions within the cavity formed by inner housing 104. Power connector 100 may be configured to receive a mating circuit interface having mating electrical contacts to couple to the plurality of electrical contacts 106 such that power connector 100 may deliver a power signal to an electronic device.

Figure 4A:
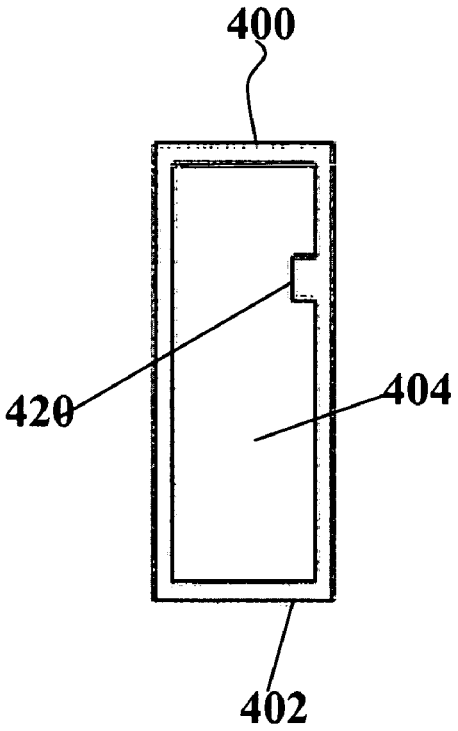
FIG. 4A illustrates a front view of a mating power connector according to an embodiment of the present invention.
Figure 4B:
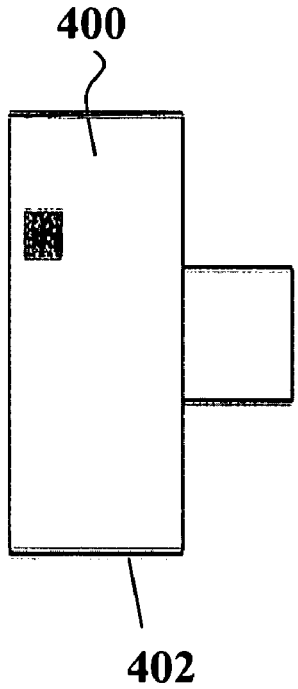
FIG. 4B illustrates a top view of a mating power connector according to an embodiment of the present invention.

FIGS. 4A and 4B illustrate a mating power connector 400 of an electronic device. Mating power connector 400 includes a housing 402 that may be substantially rectangular in shape and a keying element 420 disposed on an inner surface of the housing 402. The sides of housing 402 form a cavity 404 which is of a sufficient size and shape to accommodate or couple to the inner housing 104 of power connector 100.

Mating power connector 400 includes a plurality of mating electrical contacts (not shown) which are exposed within cavity 404 at predetermined locations corresponding to the positions of the plurality of electrical contacts 106 of power connector 100. For example, electrical contacts 106 and mating electrical contacts (not shown) may constitute a male/female pair. Of course, the mating connection could alternatively be any such mating system as is known in the art.

Figure 4C:
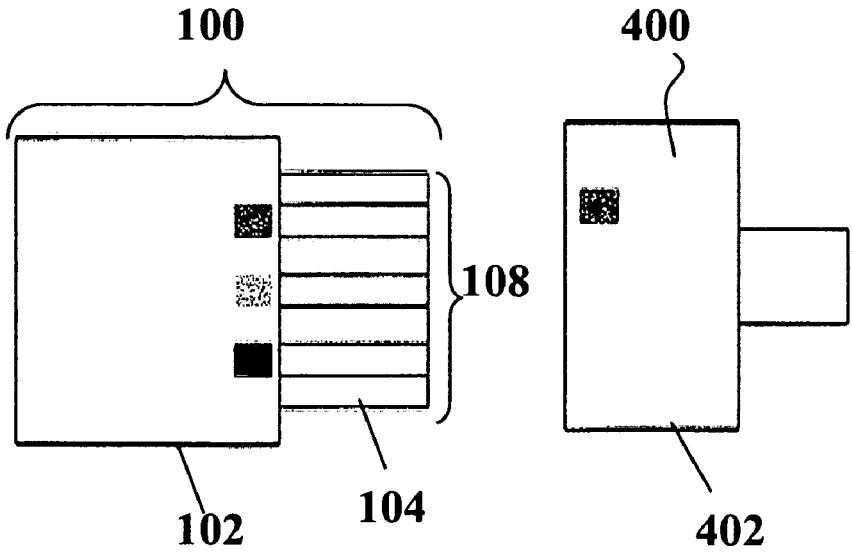
FIG. 4C illustrates a top view of a typical system according to an embodiment of the invention.

FIG. 4C illustrates a system according to an embodiment of the present invention. As shown in FIG. 4C, mating power connector 400 may be coupled to power connector 100. Inner housing 104 may act as a guide element to facilitate coupling of the connectors 100, 400. By aligning keying element 420 (not shown) with a corresponding channel of the plurality of channels 108, a user may insert the inner housing 104 of power connector 100 into cavity 404 of mating power connector 400. By coupling the mating power connector 400 and power connector 100 together, the plurality of mating electrical contacts (not shown) of mating power connector 400 may be coupled with the plurality of electrical contacts 106 of power connector 100. Coupling the power connector 100 with mating power connector 400 allows the power source 150 to deliver a power signal to an electronic device, thereby allowing the device to operate.

An embodiment of the present invention may further include a physical keying system. The physical keying system prevents a user from connecting a host device to a power source if the device is not supported by the power source.

Figure 5A:
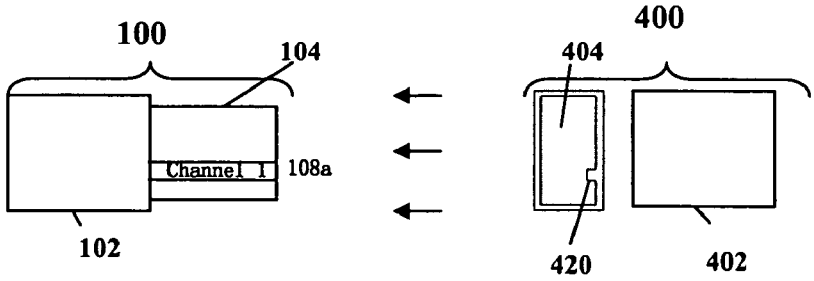
FIGS. 5A–E illustrate typical systems implementing a physical keying system according to an embodiment of the present invention.

FIGS. 5A–5E illustrate implementations of the physical keying system according to an embodiment of the present invention. As shown in FIG. 5A, power connector 100 may be configured with a channel 108*a* provided at a predetermined location along an external face of inner housing 104 (e.g. a top face, a bottom face or a side face). Channel 108*a* may correspond to a predetermined range of power which power source 150 may supply. For example the presence of channel 108*a* may indicate that the power source is capable of supplying up to 10 W of power.

Figure 5B:
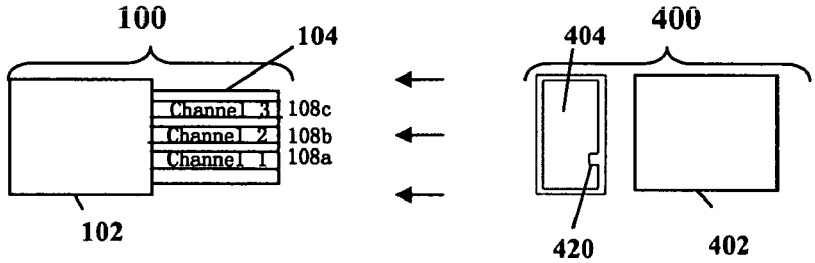
Figure 5C:
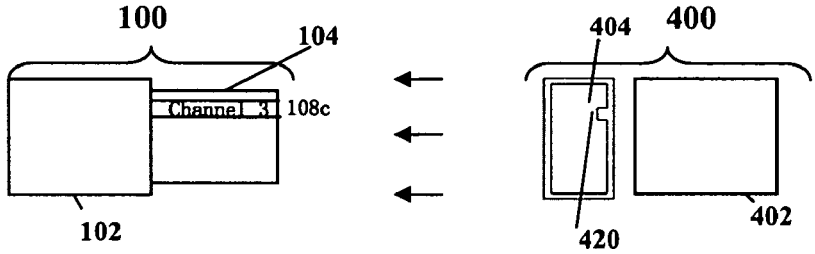

Alternatively, as shown in FIG. 5B, power connector 100 may be configured with a plurality of channels 108 arranged at predetermined locations along an external face of inner housing 104. The plurality of channels 108 may also be provided along any face of the power connector 100 (e.g. a top face, a bottom face or a side face). Each channel (108*a*, 108*b*, and 108*c*) of the plurality of channels 108 corresponds to a predetermined range of power which the power source can supply. Although in FIG. 5B only three channels (108*a*, 108*b*, and 108*c*) are provided on power connector 100, any number of channels may be provided subject to space limitations.

Each channel (108*a*, 108*b*, and 108*c*) is provided in a predetermined location to permit the electrical coupling of mating power connector 400 to the power connector 100, when the power consumption of the electronic device attached to mating power connector 400 falls within a predetermined range of power that power source 150 can supply. For example, if power source 150 is capable of outputting 100 W of power, power connector 100 of FIG. 5B having 3 channels may be configured such that, channel 108*a* is provided to permit electrical coupling of electronic devices with power consumption less than 10 W, while channel 108*b* permits electrical coupling of electronic devices with power consumption in the range greater than 10 W but less than or equal to 40 W and channel 108*c* permits electrical coupling of electronic devices with power consumption in the range greater than 40 W. The ranges of power are not limited to those provided in the example and each channel may represent any predetermined range. Further, the power ranges represented need not cover the entire range of power output for the power source 150. Rather, any portion of the power output capacity of power source 150 may be represented.

In addition, the number of power ranges represented and the ordering of the ranges on power connector 100 are not limited to those provided in the example. Rather, any number power ranges may be represented and the ranges may be represented in any order and in any combination. Referring to FIGS. 5A–E, the power connector 100 may include any one channel of 108*a*, 108*b*, and 108*c* or any combination thereof.

FIG. 5B also shows that each electronic device may be configured with a mating power connector 400 having a keying element 420. The keying element 420 may have a shape and location defined according to the power consumption of the electronic device attached. As such, keying element 420 prevents a user from coupling the electronic device to a power source that cannot supply sufficient power to operate the device. In other words, the mating power connector 400 may mate with the power connector 100 when the location and shape of the key element 420 corresponds to the location and shape of at least one channel (108*a*, 108*b*, 108*c*) of the plurality of channels 108. Accordingly, the keying element 420 of mating power connector 400 may be aligned with the corresponding channel of the plurality of channels 108 of power connector 100. Inner housing 104 of power connector 100 may then be inserted into cavity 404 of mating power connector 400 thereby permitting the coupling of the plurality of electrical contacts 106 of power connector 100 with the corresponding plurality of mating electrical contacts (not shown) of the mating power connector 400. Thus, power source 150 may deliver a power signal to an electronic device allowing the device to operate.

Figure 5D:
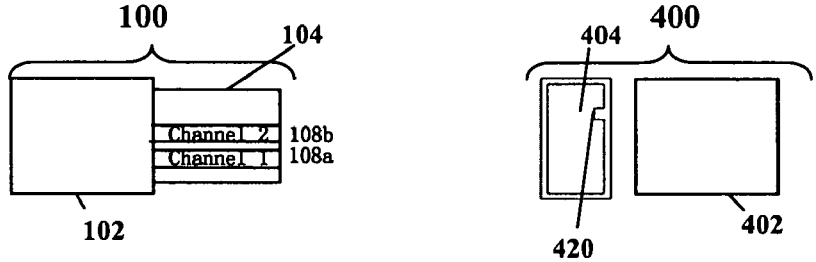
Figure 5E:
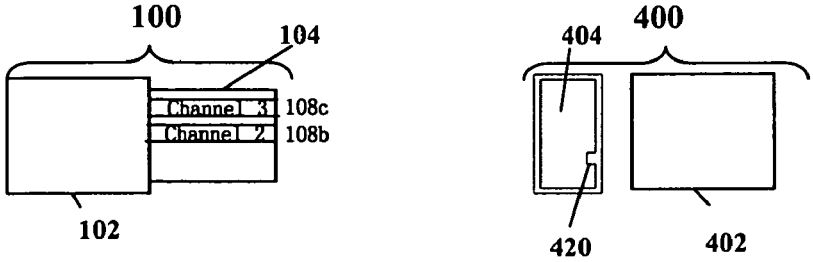

Power connector 100 may also be used to restrict the coupling of an electronic device to power source 150. As shown in FIGS. 5D and 5E, keying element 420 of mating power connector 400 is provided in a location for which there is no corresponding channel on power connector 100. The lack of a corresponding channel 108 on power connector 100 indicates that the electronic device is not supported by the power source 150. Thus, when the user attempts to insert the inner housing 104 of power connector 100 into cavity 404 of mating power connector 400, the keying element 420 will encounter inner housing 104 and prevent the connectors (100, 400) from being coupling together.

The physical keying system may be implemented in various other ways. For example, the channels 108 and keying element 420 may be provided on different faces of the respective connector (100, 400). Also, the configuration of the connectors (100, 400) may be reversed such that a plurality of channels 108 is provided on a mating power connector 400 and a keying element 420 is provided on the power connector 100.

Further, a combination of channels 108 may also be used on power connector 100 to indicate a power range. For example, the combination of channel 108*a* and 108*c* may permits electrical coupling of electronic devices with power consumption in the range greater than 70 W. Accordingly, mating power connector 400 may be similarly configured with multiple keying elements 420 to represent the power consumption of an electronic device.

An embodiment of the present invention may further include a visual keying system. The visual keying system provides the user with an indication of whether a power source is capable of outputting power sufficient to operate an electronic device prior to physical connection.

Figure 6A:
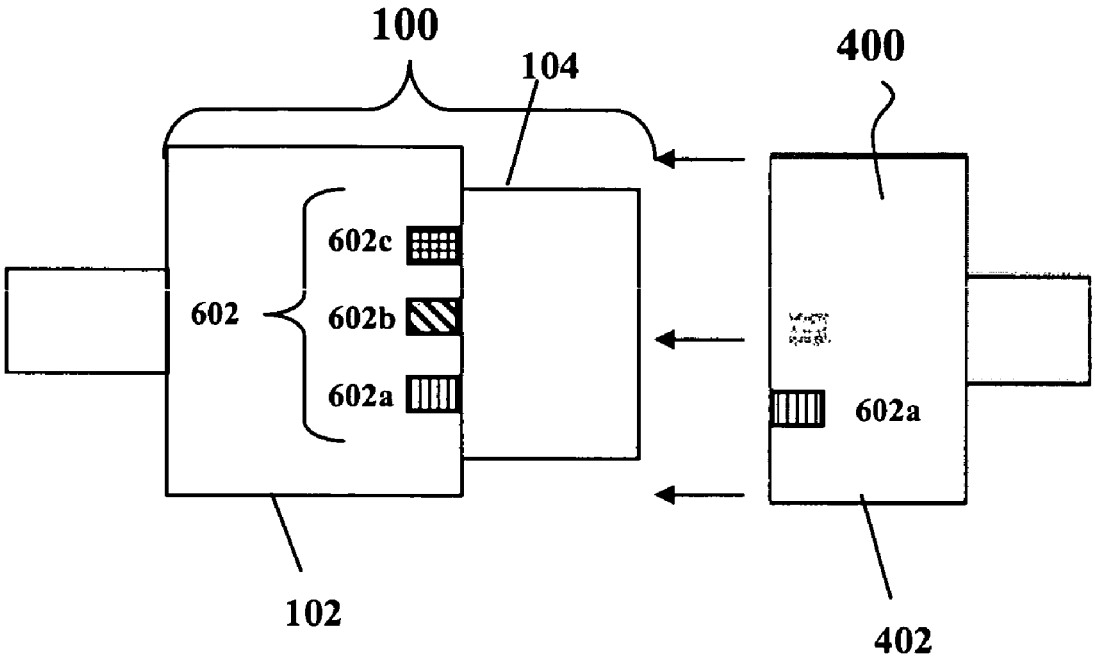
FIGS. 6A and 6B illustrate typical systems implementing a visual keying system according to an embodiment of the present invention.
Figure 6B:
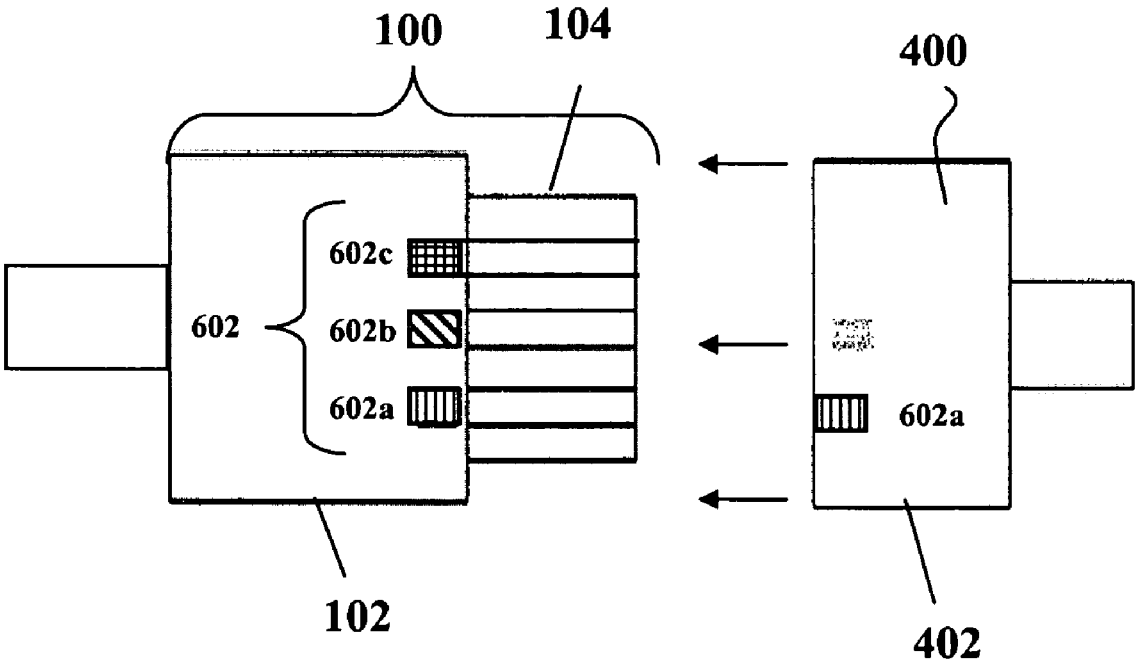

FIGS. 6A and 6B depict a connection system implementing a visual keying system according to an embodiment of the present invention. The visual keying system may use a variety of visual keys including, but not limited to, color-coded keys, numerical keys or symbolic keys. Power connector 100 is provided with a plurality of visual keys 602 on an external surface of power connector 100.

Each visual key 602*a*, 602*b*, 602*c* of the plurality of visual keys 602 indicates a predetermined power range which may be set according to the requirements of a designated class of electronic devices. Alternatively, the predetermined power range may be arbitrarily set. Based upon the power consumption of an electronic device, the mating power connector 400 of each device may be classified and assigned a visual key. For example, visual key 602*a* may correspond to the power range of 10 W or less and visual key 602*b* corresponds to 11–40 W, while visual key 602*c* corresponds to 41–69 W. Accordingly, when mating power connector 400 is coupled to a portable radio which requires 3 W of power to operate the power connector 400 may be labeled with visual key 602*a*. However, where mating power connector 400 is coupled to a laptop computer which requires 55 W of power to operate, the power connector may be labeled with visual key 602*c*.

Similarly, a power connector 100 coupled to a given power source 150 may be marked with a plurality of visual keys 602 to indicate each range of power that the power source 150 is capable of outputting. For example, using the visual keying system provided above, when power source 150 is capable of outputting 40 W, power connector 100 may be labeled with visual key 602*a* (≦10 W), visual key 602*b* (11–40 W) or both. As shown in FIG. 6A, a user is visually alerted, prior to connection, that power connector 100 is coupled to a power source 150 that is capable of supplying sufficient power to devices that consume less than 10 W of power, as well as, devices that consume power in the 11–40 W range and the 41–69 W range. In addition, a user having an electronic device with a mating power connector 400 which is labeled with visual key 602*a* will know prior to attempting a connection that the power source 150 coupled to connector 100 is capable of outputting power sufficient to operate the electronic device.

Each visual key may be placed at a predetermined position on both the power connector 100 and the mating power connector 400. As such the visual keys 602 may also serve as a guide device for proper connection. As shown in FIG. 6A, the visual key 602*a* is positioned in a corresponding vertical location on both power connector 100 and mating power connector 400. Thus, when seeking to connect mating power connector 400 to power connector 100, the user need only align the matching visual keys 602*a* to ensure successful mating of the connectors (100, 400).

In a preferred embodiment, the visual keying system may be employed in conjunction with a physical keying system. This combination keying system provides a user with an added layer of protection which may prevent the user from connecting an electronic device to a power source that does not output sufficient power to support the operation of the device. As shown in FIG. 6B, power connector 100 includes a plurality of channels 108 and visual keys 602. When a user does not recognize the presence of the visual key 602, such as when the user's hand is covering the visual keys 602, the physical keying element 420 will nevertheless prevent the user from connecting power connector 100 and mating power connector 400. Alternatively, where a user is not aware of the physical keying element 420, the visual keys 602 will alert the user prior to connection whether the power connector 100 and the mating power connector 400 are suitably configured to permit electrical coupling of the plurality of electrical contacts 106 of power connector 100 with the plurality of mating electrical contacts (not shown) of mating power connector 400. Thus, the combination keying system provides a user-friendly connection system which may prevent a user from forcibly attempting to connect power connector 100 and mating power connector 400 and damaging electrical contacts of either connector or causing damage to the power source 150 or the electronic device.

Figure 7:
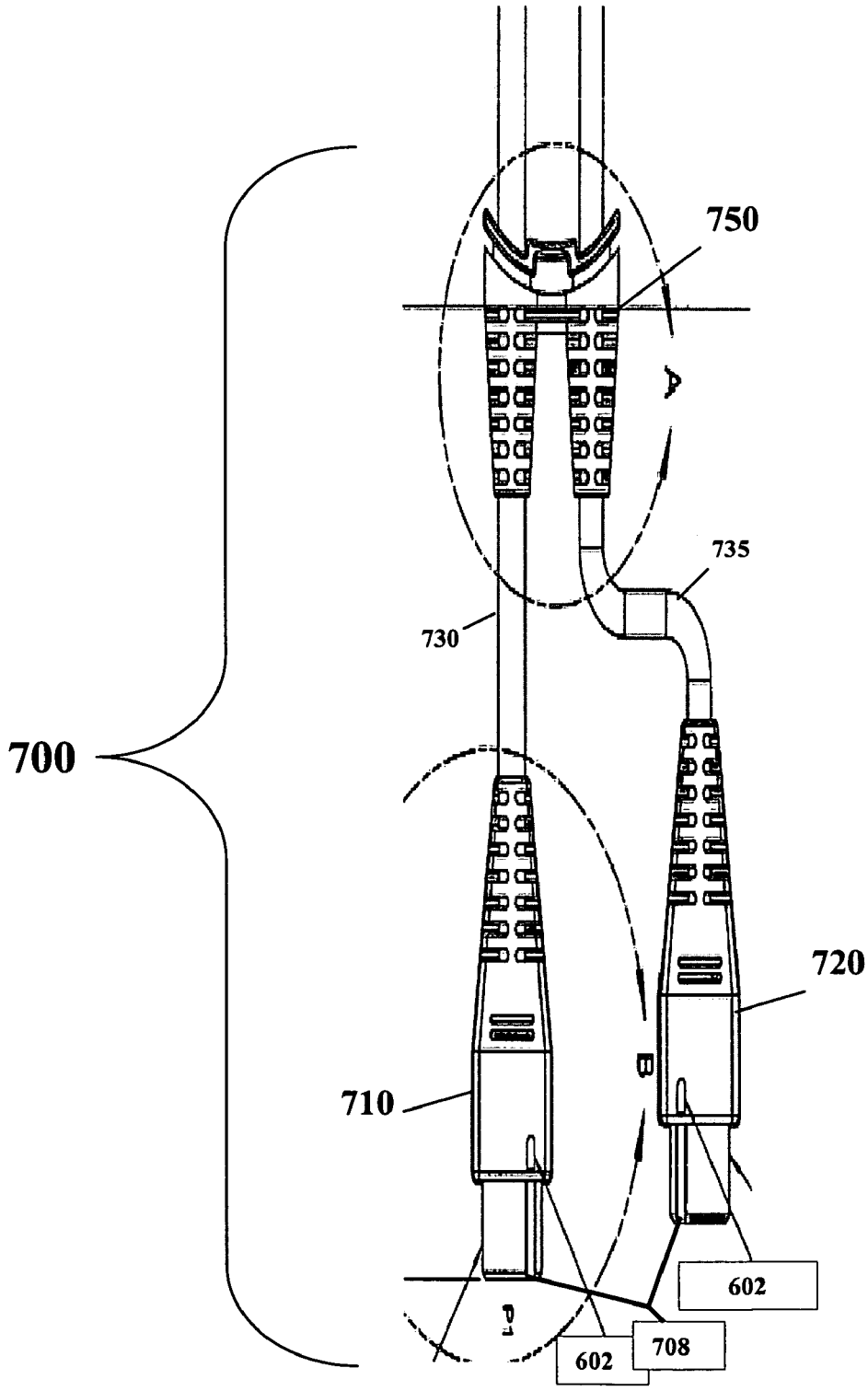
FIG. 7 illustrates at top view of a multi-connection power connector according to an embodiment of the present invention.

FIG. 7 illustrates a multi-connection power connector according to an embodiment of the present invention. Multiple power connectors may be provided to furnish additional connections to a given power source such that a user may connect multiple electronic devices to the same power source. In FIG. 7, multi-connection power connector 700 is provided having a first power connector 710 and a second power connector 720. The multi-connection power connector 700 may include more than two power connectors.

The first power connector 710 and the second power connector 720 may be structurally equivalent to the power connector 100 described above. The first power connector 710 and the second power connector 720 are held together in a chamfered harness 750 and may each be coupled to a power source 150 via cable connectors 730 and 735, respectively. The first power connector 710 and the second power connector 720 need not be coupled together and may instead be wholly separate.

In addition, the first power connector 710 and the second power connector 720 may each be configured with a visual keying system, a physical key system, or a combination thereof, as described above.

Figure 8A:
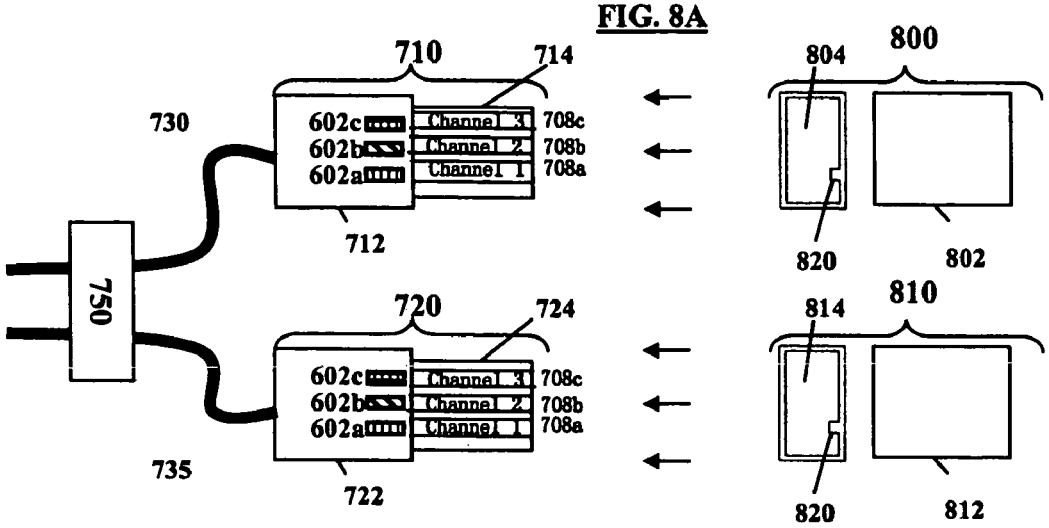
FIGS. 8A–C illustrate typical systems including a multi-connection power connector according to an embodiment of the present invention.

As shown in FIG. 8A, the first power connector 710 and the second power connector 720 may be identically configured with channels 708*a*, 708*b* and 708*c* and visual keys 602*a*, 602*b* and 602*c* such that the multi-connection power connector 700 may provide an additional power connector for a power source 150 which may output power in accordance with the power ranges represented. Alternatively, the second power connector 720 may be configured to provide support for additional power ranges. For example, where the multi-connection power connector 700 is coupled to a power source 150 capable of outputting 200 W, the first power connector 710 may be configured with channels 708*a*, 708*b* and 708*c* to permit electrical coupling of an electronic device with power consumption in the ranges less than 10 W, 11–20 W and 21–40 W, respectively. The second power connector 720 may be configured with three distinct channels to permit electrical coupling of an electronic device with power consumption in the range 41–60 W, 61–80 W, and 81–100 W, respectively. Accordingly, a user could connect a portable radio requiring 3 W of power using the first power connector 710 and a laptop computer requiring 55 W using the second power connector 720 such that power source 150 could be used to simultaneously operate both electronic devices.

Figure 8B:
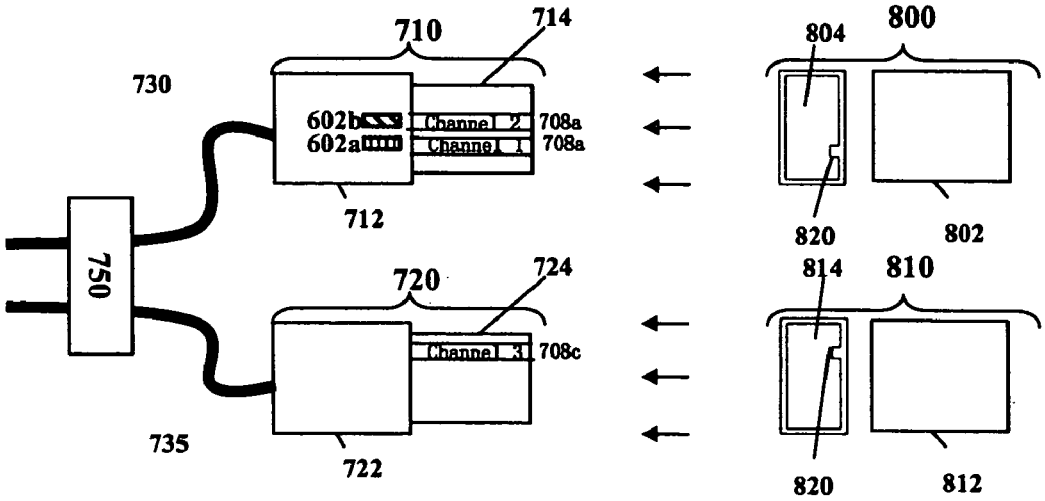
Figure 8C:
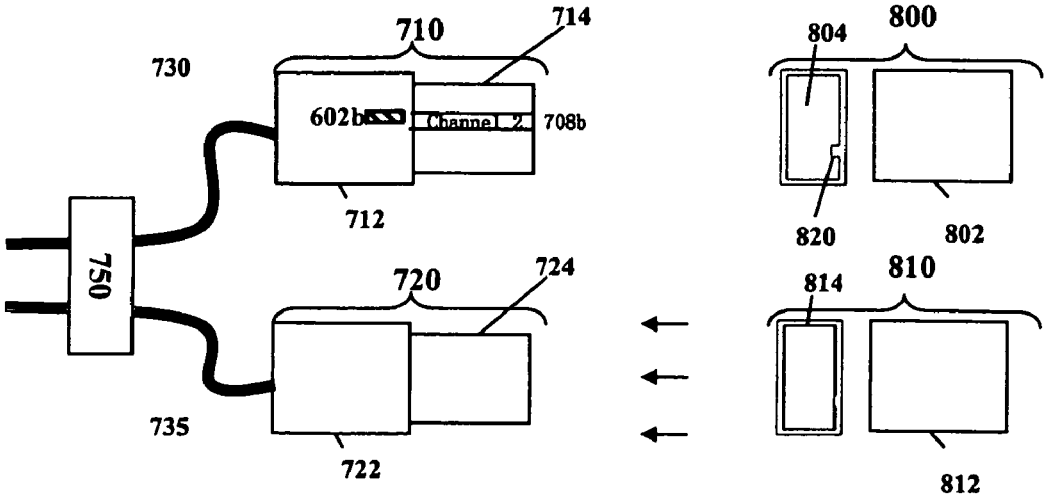

Additionally, the first power connector 710 and the second power connector 720 may be further independent in configuration. For example, as shown in FIG. 8C, the first power connector 710 may be configured with both channel 708*b* and visual key 602*b*, while the second power connector 720 includes neither a physical key or a visual key. Either of the power connectors 710, 720 may be configured with the aforementioned complement and permutations of physical key elements and visual keys.

Any number of power ranges may be represented on each power connector (710 and 720) of the multi-connection power connector 700. As shown in FIG. 8B, the first power connector 710 is configured with channel 708*a* and 708*b* while the second power connector 720 is configured with only channel 708*c*.

Further, the power ranges represented on each of the power connectors (710, 720) need not cover the entire range of power output for the power source 150. Rather, any portion of the power output capacity of power source 150 may be represented. For example, where power source is capable of outputting 100 W, the first power connector 710 may include channels 708*a* and 708*b* to permit coupling electrical coupling of electronic devices requiring less than 10 W and 11–20 W of power, respectively, but not devices requiring greater than 20 W. The second power connector 720 includes only channel 708*c* to permit coupling electrical coupling of electronic devices requiring 21–40 W, but does not support devices requiring 20 W or less or electronic devices 41–100 W.

The order of the power ranges represented on each power connector may also be arbitrarily determined. Referring to FIG. 8B, channel 708*b* may be used to permit electrical coupling of an electronic device coupled to a first mating power connector 800 requiring less than 10 W while channel 708*a* may be used to support to a device coupled to a second mating power connector 810 requiring 11–20 W.

The multi-connection power connector 700 may be used to restrict the coupling of electronic devices to a power source. In FIG. 8C, an electronic device coupled to a first mating power connector 800 will be prevented from being coupled to the first power connector 710 of the multi-connection power connector 700 since the keying element 820 of the first mating power connector 800 does not correspond to the location and shape of channel 708*b* of the first power connector 710. However, an electronic device coupled to second mating power connector 810, which has no physical keying element will be allowed to couple to the second power connector 720 which utilizes neither a physical keying element or a visual keying element. Thus the power source 150 coupled to the second power connector 720 may deliver sufficient power to operate the device coupled to the second mating power connector 812.

While the description above refers to particular embodiments of the present invention, it will be understood that many alternatives, modifications and variations may be made without departing from the spirit thereof. The accompanying claims are intended to embrace such alternatives, modifications and variations as would fall within the true scope and spirit of the present invention. The presently disclosed embodiments are therefore to be considered in all respects as illustrative and not restrictive, the scope of the invention being indicated by the claims, rather than the foregoing description, and all changes which come within the meaning and range of equivalency of the claims are therefore intended to be embraced therein.

What is claimed is:

1. A power connector comprising:

a first housing, coupled to a power source, to shield the power connector from external conditions;

a second housing, coupled to the first housing, having at least one electrical contact to receive at least one mating electrical contact;

at least one physical key element to couple the at least one electrical contact to the at least one mating electrical contact; and a plurality of visual key elements, each visual key element of the plurality of visual key elements being provided to visually indicate a range of power which may be output by the power source, to visually indicate whether the at least one electrical contact and the at least one mating electrical contact are properly connectable, and to visually indicate proper alignment and orientation for coupling the at least one electrical contact with the at least one mating electrical contact.

2. The power connector of claim 1, further configured to transmit a power signal from the power source to the mating electrical contacts.

3. The power connector of claim 1, wherein the at least one physical key element is provided on an external surface of the first housing of the power connector.

4. The power connector of claim 1, wherein each visual key element of the plurality of visual key elements is color-coded.

5. A power connection system comprising:

a first power connector having at least one electrical contact to receive at least one mating electrical contact, wherein the first power connector is coupled to a power source and the first power connector is configured with a plurality of visual key elements and at least one physical key element; and a second power connector having at least one mating electrical contact, the second power connector being configured with a mating visual key element and at least one mating physical key element wherein the second power connector is coupled to a device, the mating visual key element visually indicates whether the at least one electrical contact and the at least one mating electrical contact are properly connectable, and visually indicates a proper alignment and orientation for coupling the at least one electrical contact of the first power connector with the at least one mating electrical contact of the second power connector, and the at least one mating electrical contact of the second power connector is prevented from coupling to the at least one electrical contact of the first power connector unless the at least one mating physical key element of second power connector corresponds to the at least one physical key element of the first power connector.

6. The system of claim 5, wherein the power source is a power supply.

7. The system of claim 5, wherein the power source is a battery.

8. The system of claim 5, wherein each visual key element of the plurality of visual key elements is assigned based on a range of power that the power source is capable of outputting.

9. The system of claim 5, wherein the mating visual key element is assigned based on the power consumption of the device.

10. The system of claim 5, wherein the first power connector is configured to transmit a power signal from the power source to the at least one mating electrical contact of the second power connector.

11. A method for preventing an improper power connection comprising:

configuring a first power connector with at least one physical key element and a plurality of visual key elements, wherein the first power connector is coupled to a power source capable of generating a power signal and includes at least one electrical contact to receive a mating electrical contact;

configuring a second power connector with at least one mating physical key element and a mating visual key element, the second power connector having at least one mating electrical contact;

providing a visual indication of whether the at least one electrical contact and the at least one mating electrical contact are properly connectable based on a comparison of the mating visual key element and the plurality of visual key elements;

providing a visual indication of a proper alignment and orientation for coupling the at least one electrical contact of the first power connector with the at least one mating electrical contact of the second power connector by aligning the mating visual key element with a corresponding visual key element of the plurality of visual key elements; and restricting coupling of the at least one electrical contact of the first power connector to the at least one mating electrical contact of the second power connector unless the at least one physical key element corresponds to the at least one mating physical key element.

12. The method of claim 11, further comprising:

transmitting the power signal from the at least one electrical contact of the first power connector to the at least one mating electrical contact of the second power connector when the at least one physical key element corresponds to the at least one mating physical key element and the first power connector is coupled to the second power connector.

13. The method of claim 11, wherein the each visual key element of the plurality of visual key elements is assigned based on a range of power that the power source is capable of outputting.

14. The method of claim 11, wherein the mating visual key element is assigned based on the power consumption of a device coupled to the second power connector.

15. A multi-connection power connector, comprising:

a plurality of power connectors, wherein each power connector of the plurality of power connectors is configured with at least one electrical contact to receive at least one mating electrical contact, each power connector of the plurality of power connectors is configured with a plurality of visual key elements, and a physical key element, each of the visual key elements being provided to visually indicate whether the at least one electrical contact and the at least one mating electrical contact are properly connectable, and to visually indicate proper alignment and orientation for coupling the at least one electrical contact with the at least one mating electrical contact and each power connector of the plurality of power connectors is coupled to a power source.

16. The multi-connection power connector of claim 15, wherein the physical key element is provided on an external surface of each power connector of the plurality of power connectors.

17. The multi-connection power connector of claim 15, wherein the visual key element is provided on an external surface of the at least one power connector of the plurality of power connectors to visually indicate a range of power which may be output by the power source.

18. The multi-connection power connector of claim 15, wherein the plurality of power connectors are coupled together.

19. The multi-connection power connector of claim 15, wherein each power connector of the plurality of power connectors is further configured to transmit a power signal from the power source to the mating circuit interface.

* * * * *